US006918778B2

(12) United States Patent
Ruckerbauer et al.

(10) Patent No.: US 6,918,778 B2
(45) Date of Patent: Jul. 19, 2005

(54) CONFIGURATION, PLUG-IN MOUNT AND CONTACT ELEMENT FOR FIXING AND CONTACTING SWITCHING ASSEMBLIES ON A SUBSTRATE

(75) Inventors: Hermann Ruckerbauer, Moos (DE); Maksim Kuzmenka, München (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/609,871

(22) Filed: Jun. 30, 2003

(65) Prior Publication Data

US 2004/0067666 A1 Apr. 8, 2004

(30) Foreign Application Priority Data

Jun. 28, 2002 (DE) ..... 102 29 167

(51) Int. Cl.[7] ..... H01R 13/15
(52) U.S. Cl. ..... 439/260; 439/637; 200/51.1
(58) Field of Search ..... 439/260, 62, 637, 439/188; 200/51.1, 51.09

(56) References Cited

U.S. PATENT DOCUMENTS 3,920,302 A * 11/1975 Cutchaw ..... 439/188
4,894,022 A * 1/1990 Guckenheimer ..... 439/260
5,308,249 A 5/1994 Renn et al.
6,206,713 B1 3/2001 Baertsoen et al.
6,296,491 B1 10/2001 Pickles
6,524,114 B2 * 2/2003 Watanabe et al. ..... 439/65

FOREIGN PATENT DOCUMENTS

| | | |
|---|---|---|
| DE | 256 022 A1 | 12/1986 |
| DE | 256 023 A1 | 12/1986 |
| DE | 35 40 029 A1 | 5/1987 |
| DE | 44 20 663 A1 | 12/1994 |
| DE | 197 30 484 C1 | 10/1998 |
| EP | 0 415 052 A1 | 3/1991 |

* cited by examiner

*Primary Examiner*—Neil Abrams
*Assistant Examiner*—Phuong Dinh
(74) *Attorney, Agent, or Firm*—Laurence A. Greenberg; Werner H. Stemer; Ralph E. Locher

(57) ABSTRACT

Contact elements of a plug-in mount are connected in an electrically conducting manner to conductive contact zones on a surface of a substrate after the plug-in mount has been loaded with a switching assembly and are electrically isolated from the signal lines in the unloaded state. Therefore, higher clock rates for the signals transmitted on the signal lines are made possible in not completely expanded systems having empty mounting locations.

13 Claims, 4 Drawing Sheets

CONFIGURATION, PLUG-IN MOUNT AND CONTACT ELEMENT FOR FIXING AND CONTACTING SWITCHING ASSEMBLIES ON A SUBSTRATE

BACKGROUND OF THE INVENTION

FIELD OF THE INVENTION

The invention relates to a configuration for fixing and contacting a switching assembly, having contact areas, on a substrate. The configuration contains signal lines disposed on the substrate and a plug-in mount, having at least one receiving device and contact elements, for receiving the switching assembly and for mounting on the substrate. The invention also relates to a plug-in mount and contact elements for such a configuration.

In the case of modular electronic systems with a variable configuration, a system board with a mounting location or a plurality of mounting locations for modular components is usually provided. The mounting locations are respectively loaded with a modular component in accordance with the requirements for the system or with the expansion stage of the system, or remain unloaded. The interfaces of the modular components are in this case necessarily the same or compatible with one another. Beyond that, no functional similarity of the modular components is required. The modular components are, for instance, switching assemblies such as memory modules or interface modules.

The mounting locations are usually formed as plug-in mounts that are fixed on a substrate, for instance a system board (motherboard). The plug-in mounts also respectively establish an electrical connection between signal lines on the substrate and contact areas on the switching assemblies.

The plug-in mounts make it possible for switching assemblies to be easily exchanged, or easily retrofitted.

A typical example of such a modular system is a computer system (PC, workstation, server) with an expandable main memory, mounting locations (slots) for memory modules being provided on the system board in the form of plug-in mounts and being loaded with memory modules in accordance with the desired size of the main memory. Since the number of mounting locations in a system is based on a maximum expansion, generally one or more plug-in mounts are not used. Since, furthermore, a bus system with a smaller number of memory modules allows a higher data transmission rate, maximum expansion of the system is also deliberately dispensed with in applications where speed is relevant.

With higher clock rates and data transmission rates to and from the memory modules, the requirements imposed on the forming of the signal lines of the bus system increase. To ensure higher clock rates on the bus systems, generally short signal lines, lowest possible parasitic capacitances, inductances and resistances, and also the smallest possible number of reflection points along the signal lines are required.

Even in the unloaded state, configurations with customary plug-in mounts have a high parasitic capacitance and at least one considerably disruptive reflection point.

SUMMARY OF THE INVENTION

It is accordingly an object of the invention to provide a configuration, a plug-in mount and a contact element for fixing and contacting switching assemblies on a substrate that overcome the above-mentioned disadvantages of the prior art devices of this general type, in which the signal integrity in a configurable modular system is improved in comparison with conventional configurations when it is in an incomplete system configuration. A second object of the invention is to provide a plug-in mount for the configuration according to the invention. In addition, it is an object of the invention to provide a contact element for a plug-in mount according to the invention.

With the foregoing and other objects in view there is provided, in accordance with the invention, a configuration for fixing and contacting a switching assembly having contact areas on a substrate having a surface. The configuration contains a plug-in mount disposed on the substrate for receiving the switching assembly and has at least one receiving device and a contact element with a contact region. Signal lines are disposed on the substrate. The signal lines have contact zones disposed on the surface of the substrate facing the plug-in mount, and in an unloaded state of the configuration, without the switching assembly disposed in the receiving device, the contact element is electrically isolated from the contact zones, and in a loaded state of the configuration, with the switching assembly disposed in the receiving device, the contact region of the contact element electrically contacts at least one of the contact zones on the substrate.

In the case of the configuration according to the invention, the contact elements of the plug-in mount in the unloaded state of the plug-in mount therefore do not have contact with the signal lines embossed on the substrate. The contact elements are connected in an electrically conducting manner to the signal lines of a bus system exclusively in the loaded state of the plug-in mount.

The configuration according to the invention has in the unloaded state no reflection locations and no additional, parasitic capacitances that impair the signal integrity on the signal lines. The configuration according to the invention makes higher clock and data transmission rates possible for bus systems in the case of incomplete system configurations.

To be specific, the configuration according to the invention for fixing and contacting switching assemblies on the substrate contains signal lines disposed on the substrate that have contact zones on a surface of the substrate facing the plug-in mount. Furthermore, the configuration according to the invention contains a plug-in mount with at least one receiving device and contact elements which in the loaded state of the plug-in mount respectively lie opposite corresponding contact areas of a switching assembly disposed in the receiving device and contact the assembly.

The contact elements are formed furthermore in such a way that, in the loaded state of the configuration, the contact elements are electrically contacted respectively in a first contact region with one of the contact zones on the substrate. In an unloaded state, without the switching assembly disposed in the receiving device, the contact elements are electrically isolated from the contact zones.

The contact elements preferably have in each case a second contact region, by which, in the loaded state, the respective contact element is electrically contacted with at least one contact area on the switching assembly.

The receiving device is preferably formed as a groove in an insulating body. The contact elements are respectively provided in rows on one or two inner surfaces of the groove and lying opposite contact areas disposed on at least one edge of the switching assembly. In addition, if required, the receiving device has customary specialist formations, such as coding devices, additional guiding and fixing elements or an ejecting mechanism.

According to a preferred embodiment of the configuration according to the invention, the contact elements are formed as contact spring elements that are relaxed in the unloaded state and tensioned in the loaded state.

In the case of a further preferred embodiment of the configuration according to the invention, the contact elements disposed in the plug-in mount are provided in such a way that they are displaceable at least in a direction perpendicular to the substrate. In this case, the contact element is in a position remote from the substrate in the unloaded state and in a position near the substrate in the loaded state. In the near position, the contact element rests on the corresponding contact zone, while in the remote position the contact element is electrically isolated from the contact zone.

A particularly preferred form of the configuration according to the invention contains contact elements that are respectively elastically deformable in a direction perpendicular to the substrate and parallel to the substrate. In the unloaded state of the plug-in mount, the contact elements have a minimal extent in the direction perpendicular to the substrate and a maximum extent in the direction parallel to the substrate. In this case, the first contact regions of the contact elements are without contact with respect to the contact zones of the signal lines.

In the loaded state, the contact elements have a maximum extent in the direction perpendicular to the substrate and a minimal extent in the direction parallel to the substrate. In this case, the contact elements in the first contact region contact the corresponding contact zones of the signal lines and in the second contact region contact the corresponding contact areas of the switching assembly.

Such a contact element can be realized in various ways, for instance be formed in a unshaped manner, the second contact region is formed on one of the legs of the u-shaped contact element and the first contact region being formed on the crosspiece. The contact element is preferably formed in an annular manner and fixed at an anchoring point to the inner side of the receiving device. By being formed as a ring, the contact element is made more rigid and able to undergo mechanical loading.

According to a further form of the configuration according to the invention, the first and second contact regions of a contact element are respectively disposed such that they can be pivoted about a common axis of rotation and offset with respect to one another by an angle which is preferably at least 20 degrees. In the unloaded state, at least one of the contact regions or a mechanical lever element is located at least partly in the feed path of a switching assembly to be disposed in the receiving device of the plug-in mount. The feeding of the switching assembly has the effect that both contact regions of the contact element are pivoted into a loading position, in which the contact regions electrically contact the contact zones or contact areas. Furthermore, during the feeding of the switching assembly, a spring force device, for instance a torsional moment of the axis of rotation, is tensioned. When the switching assembly is removed, the spring force device pivots the contact element back again into the starting position, in which the first contact region is not contacting the contact zone. An advantageous form of the configuration is obtained if the contact arms are offset with respect to one another by about 45 to 135 degrees or 160 to 180 degrees.

According to a further particularly preferred embodiment of the configuration according to the invention, the signal lines on the substrate have interruption points and two partial contact zones, which are disposed on either side of the interruption point and can be bridged by the first contact region of the contact element corresponding to the signal line, so that in the loading case the two partial contact zones of the signal line are respectively electrically connected to one another.

This embodiment of the invention is particularly advantageous, because the line lengths of the signal lines are adapted to the actual system expansion in a very easy and economical way. It merely has to be ensured that the plug-in mounts are loaded in a fixed sequence. The signal lines of the bus system are interrupted at the first unloaded plug-in mount and are respectively lengthened further as required by simple loading. As a result, the clock rate can be adapted to the respective system configuration.

In the case of continuous uninterrupted loading of the plug-in mounts, starting from a control module disposed on the substrate or on a further plug-in mount, a first partial contact zone is oriented with respect to the control module and a second partial contact zone is oriented with respect to the unloaded plug-in mounts.

Terminating zones, which are respectively electrically connected to a termination, which may also be disposed on the rear side of the substrate, are advantageously provided on the surface of the substrate.

The contact elements additionally have for this purpose a third contact region. By the third contact region, a terminating zone and the first partial contact zone are respectively connected in an electrically conducting manner in the unloaded state, while the terminating zone is isolated from the first partial contact zone in the loaded state. In the case of this embodiment of the configuration according to the invention, the signal lines are terminated at the first unloaded plug-in mount respectively during continuous uninterrupted loading of the plug-in mounts. The configuration of the termination is consequently adapted to the respective system configuration in a very easy and economical way.

The contact zones are preferably provided with a greater transverse extent than the signal lines, in order to increase a contacting area with the contact elements. As a result, a smaller contact resistance and more reliable contacting are achieved.

The greater transverse extent leads to a reduced impedance of the signal lines and consequently to a mismatch. The mismatch when there is a short contact zone in relation to a wavelength of a signal transmitted on the signal line can be compensated by an increased impedance, that is portions of smaller transverse extent of the signal line before and/or after the contact zone.

Since, however, in the case of contact zones with a greater transverse extent the transitions between the signal lines and the contact zones also form reflection points, according to a further preferred embodiment the contact zones are provided with the same cross section as the signal lines. Reliable contacting is then ensured by coating the contact zones with a particularly suitable material, for instance a gold alloy.

A configuration according to the invention of the type described also contains in each case a plug-in mount according to the invention, as already described in connection with the configuration according to the invention.

Similarly, a plug-in mount according to the invention of the type described also has in each case a plurality of contact elements according to the invention, as already described in connection with the configuration according to the invention.

Other features which are considered as characteristic for the invention are set forth in the appended claims.

Although the invention is illustrated and described herein as embodied in a configuration, a plug-in mount and a contact element for fixing and contacting switching assemblies on a substrate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
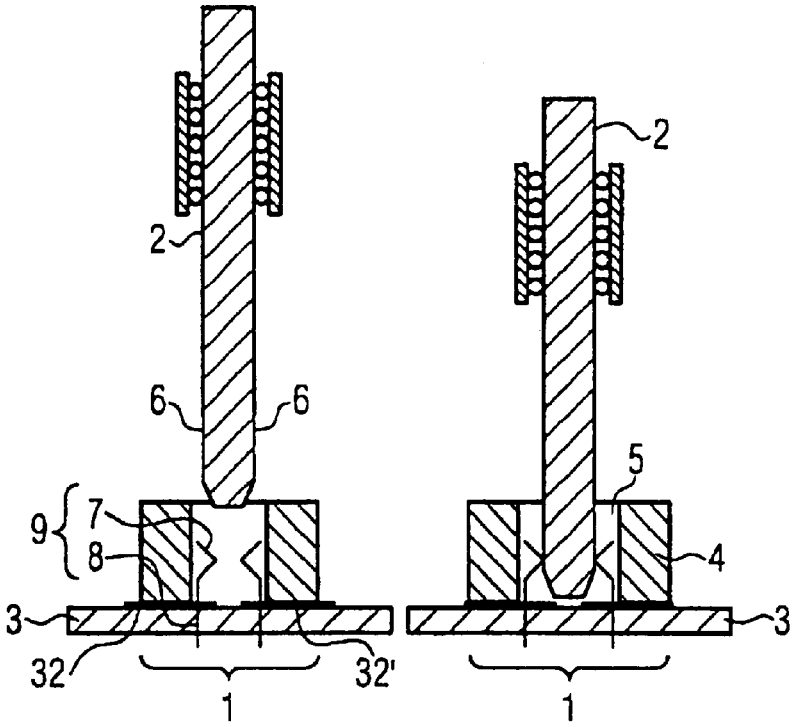
FIG. 3 Prior Art
FIG. 3 is cross-sectional view of a conventional configuration according to the prior art.

Referring now to the figures of the drawing in detail and first, particularly, to FIG. 3 thereof, there is shown a configuration of a plug-in mount 1 disposed on a substrate 3 according to the prior art. The plug-in mount 1 contains an insulating body 4, in which a receiving device 5 for receiving a switching assembly 2 is provided. The switching assembly 2 has contact areas 6. Disposed in the receiving device 5 are contact pins 9 each with a contact element 7 and a contact device 8. The contact devices 8 are connected in an electrically conducting manner to signal lines 32, 32' disposed on or in the substrate 3.

In the illustration on the right of FIG. 3, the plug-in mount 1 is loaded with the switching assembly 2 disposed in the receiving device 5. The contact elements 7 contact the respectively corresponding contact areas 6.

In the illustration on the left of FIG. 3, the plug-in mount 1 is unloaded. The contact elements 7 respectively form an antenna-like stub of assigned signal lines 32, 32'. The stub forms a capacitance, which deforms a signal shape of a signal transmitted on the signal line 32, or delays the signal. End points and edges of the contact elements 7 are reflection locations. Signals reflected there act as interference signals for the signals transmitted on the signal lines 32, 32'. In general, customary plug-in mounts in high-speed bus systems in the empty, unloaded state lead to increased interferences and, as a result, restrict the possible data transmission rate within the bus system.

Figure 1:
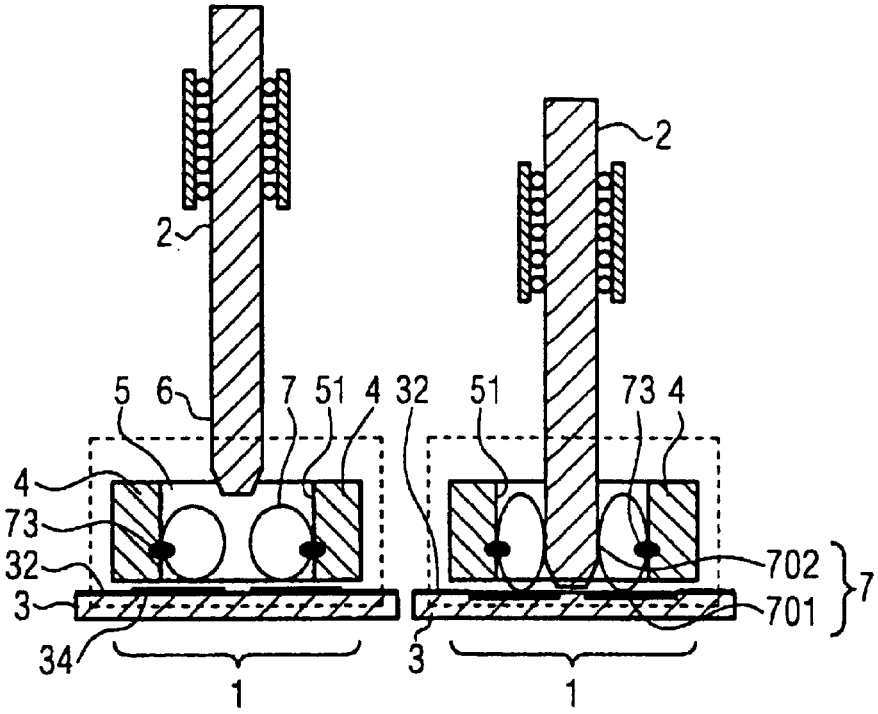
FIG. 1 is a diagrammatic, cross-sectional view of a configuration according to the invention on the basis of a first exemplary embodiment according tohe invention.

This problem is solved in accordance with the invention, and as shown in FIG. 1, by the plug-in mount 1 disposed on the substrate 3. The plug-in mount 1 in this case contains the insulating body 4, in which the receiving device 5, formed as a groove, for receiving the switching assembly 2 is formed. The switching assembly 2 has the contact areas 6. Disposed in the receiving device 5 are annular, elastic contact elements 7, which are respectively fixed at an anchoring point 73 provided on an inner side 51 of the receiving device 5.

The substrate 3 has signal lines 32 with contact zones 34. In the region of the contact zones 34, the signal lines 32 are formed on the surface of the substrate 3 without any covering insulation. In addition, the contact zones 34 may be coated with a material that has good contact properties. The contact zones 34 are in this case respectively disposed underneath corresponding contact elements 7.

In the illustration on the left of FIG. 1, the plug-in mount 1 is represented in the unloaded state. The contact elements 7 are in the relaxed state and without contact with respect to the respectively corresponding contact zones 34 on the substrate 3. In an extent parallel to the surface of the substrate 3, the contact elements 7 extend into a feed path of a switching assembly 2 to be disposed in the receiving device 5.

If the plug-in mount 1 is then loaded, in that the switching assembly 2 is fed into the receiving device 5, the contact elements 7 are compressed in a direction horizontal to the surface of the substrate 3. At the same time, the extent of the contact elements 7 in the direction perpendicular to the surface of the substrate 3 increases.

In the illustration on the right of FIG. 1, the plug-in mount 1 is shown loaded with the switching assembly 2 disposed in the receiving device 5. The contact elements 7 are respectively contacting the contact zones 34 of the signal lines 32 on the substrate 3 in a first contact region 701 and the contact areas 6 on the switching assembly 2 in a second contact region 702.

If the switching assembly 2 is removed from the receiving device 5, the contact elements 7 relax and revert to the original shape. The contacting between the contact element 7 and the corresponding contact zones 34 is discontinued.

In the unloaded state, the contact elements 7 are electrically isolated from the signal lines 32 and do not form any parasitic impedance or any reflection point for signals transmitted on the signal lines 32.

Figure 2:
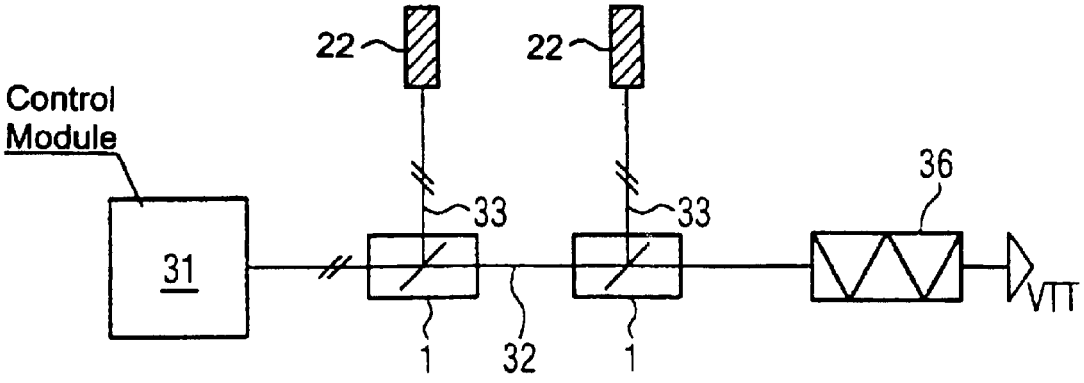
FIG. 2 is a block diagram of a line-bus system.

In FIG. 2, a configuration with a line-bus system (stub bus) with the signal lines 32 routed between a control module 31 and terminations 36 is schematically represented. The system has two mounting locations for memory modules 22. The mounting locations are provided as the plug-in mounts 1. For each plug-in mount 1, a stub 33 is respectively provided from the signal lines 32 of the line-bus system.

Figure 4:
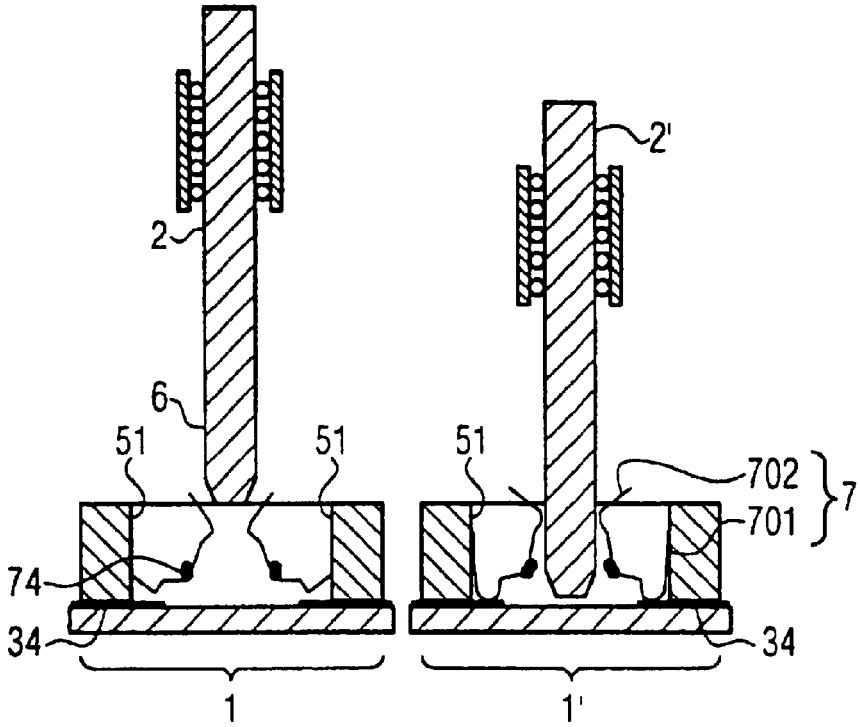
FIG. 4 is a cross-sectional view of the configuration according to the invention on the basis of a second exemplary embodiment of the invention.

The configuration represented in FIG. 4 differs from the configuration shown in FIG. 1 in the form of the contact elements 7. The two contact regions 701, 702 of the contact element 7 are disposed on different contact arms of the contact element 7. The contact arms are in this case provided such that they can pivot about a common axis of rotation 74.

In the illustration on the left of FIG. 4, the plug-in mount 1 is unloaded. The contact elements 7 are in the relaxed state. The contact arms having the first contact regions 701 are without contact with respect to the contact zones 34 on the substrate 3. The contact arms having the second contact region 702 extend into a feed path of the switching assembly 2 to be disposed in the receiving device 5. Chance contacting between the contact elements 7 and the contact zones 34, for instance due to mechanical vibration, is avoided by the contact elements 7 bearing against the inner sides. 51 of the receiving device 5.

If the plug-in mount 1 is then loaded, in that the switching assembly 2 is disposed in the receiving device 5, the contact arms having the second contact regions 702 are pivoted away from the switching assembly 2. At the same time, the other contact arm, respectively, with the first contact region 701, is pivoted in a direction toward the surface of the substrate 3.

In the illustration on the right of FIG. 4, the plug-in mount 1 is loaded with the switching assembly 2 disposed in the receiving device 5. The contact elements 7 are respectively contacting the contact zones 34 of the signal lines 32 on the substrate 3 in the first contact region 701 and the contact areas 6 on the switching assembly 2 in the second contact region 702.

When the plug-in mount 1 is loaded, a spring force device, which in the simplest case is realized by a torsional moment of the axis of rotation 74, is tensioned at the same time. If the switching assembly 2 is removed from the receiving device 5, the spring force devices relax and the contact elements 7 pivot back again into the starting position.

Figure 5A:
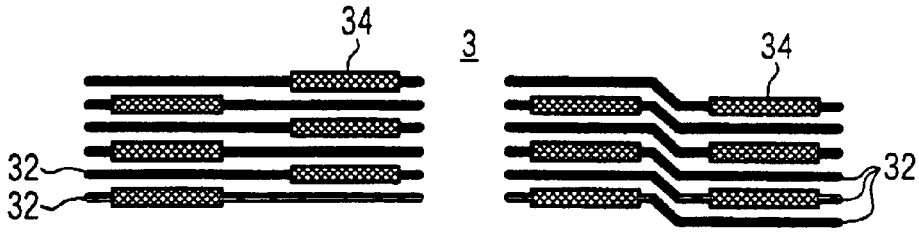
FIGS. 5A and 5B are plan views of a substrate in a detail of the configuration according to the invention with signal lines having contact zones on the basis of the first or second exemplary embodiment of the configuration according to the invention.
Figure 5B:
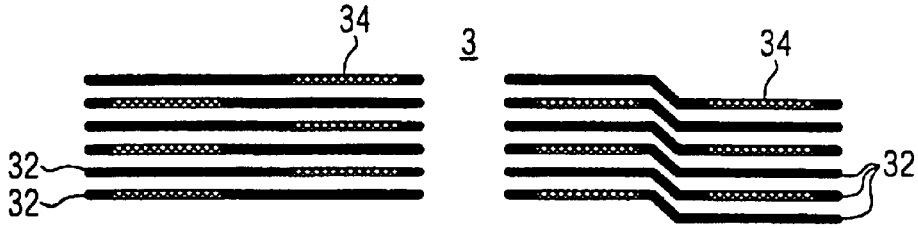

FIGS. 5A and 5B respectively show portions of the signal lines 32 with the contact zones 34 in a plan view of the substrate 3. In this case, the routing of the signal lines 32 respectively represented on the left is obtained if the contact zones 34 are disposed in two rows lying offset opposite one another in a way corresponding to a configuration of corresponding contact areas of the switching assemblies. The routing of the signal lines 32 respectively represented on the right is obtained if the contact areas of the switching assemblies lie in two rows directly opposite one another.

In FIG. 5A, the contact zones 34 are provided with a greater transverse extent than the signal lines 32, in order to increase a contacting area with the contact elements. As a result, a smaller contact resistance and more reliable contacting are achieved. However, the transitions between the signal lines 32 and the contact zones 34 form reflection points and the widened contact zones 34 form a reduced impedance.

In FIG. 5B, the contact zones 34 are provided with the same transverse extent as the signal lines 32, whereby reflection points are avoided and the impedance is not reduced. Reliable contacting is ensured by coating the contact zones 34 with a particularly suitable material, for instance a gold alloy.

Figure 6A:
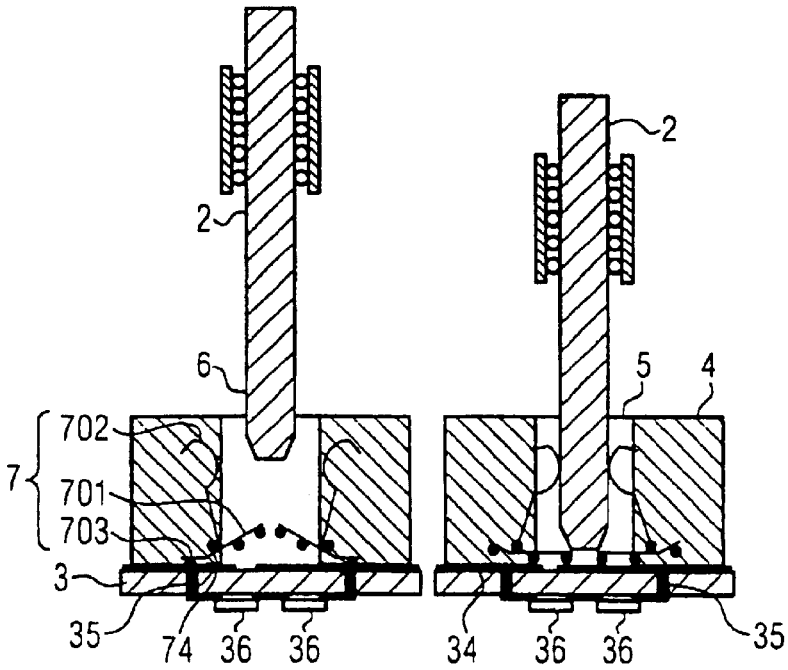
FIG. 6A is a cross-sectional view of the configuration according to the invention on the basis of a third exemplary embodiment of the invention.

A further configuration with contact elements 7 with contact regions 701, 702 provided on pivotable contact arms is shown in FIG. 6A.

The plug-in mount represented in FIG. 6A has in this case contact elements 7 with an additional contact region 703 disposed on a third contact arm. In the unloaded state, the third contact region 703 respectively contacts a terminating zone 34' disposed on the surface of the substrate 3.

The terminating zones 34' are connected in an electrically conducting manner respectively by via holes 35 to terminations 36 fixed on a rear side of the substrate 3 facing away from the plug-in mount 1.

The contact zones disposed on the surface of the substrate 3 facing the plug-in mount 1 are divided into partial contact zones 341 and 342 lying opposite one another at an interruption point 37.

In the illustration on the left of FIG. 6A, the plug-in mount 1 is unloaded. The contact elements 7 are in the relaxed state. The contact arms having the first contact regions 701 are without contact with respect to the second partial contact zones 342 on the substrate 3 and extend into a feed path of a switching assembly 2 to be disposed in the receiving device 5.

Figure 6B:
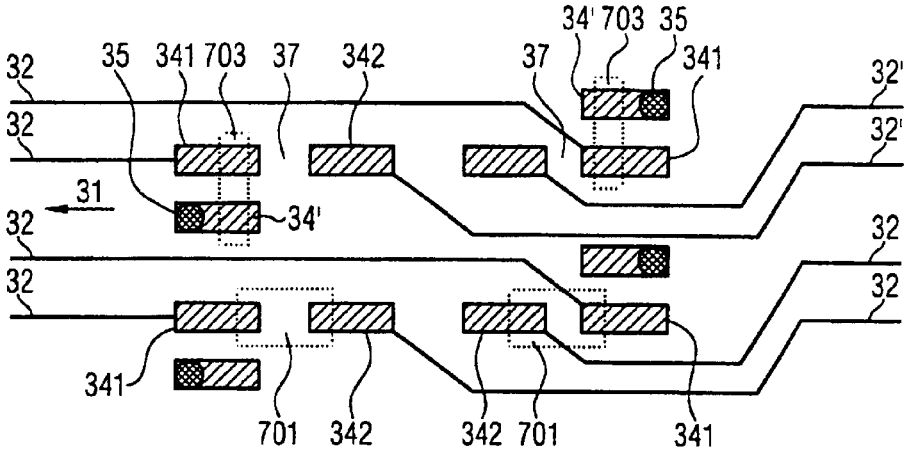
FIG. 6B is a plan view of the substrate in a detail of the configuration.

As represented in the upper part of FIG. 6B, in the unloaded state the first partial contact zone 341 is respectively connected in an electrically conducting manner to the assigned terminating zone 34' by the third contact region 703. The corresponding partial contact zones 341 and 342, on the other hand, are isolated from one another, so that the signal lines 32 leading to the control module 31 end at the first partial contact zones 341 or the terminations 36.

Consequently, in the case of continuous successive loading of the plug-in locations 1 of a system, the signal line 32 is terminated by a first unloaded plug-in mount in a convenient manner without further measures. The termination always takes place at the point suitable for it, without further intervention. In this way, the signal lines 32 can be advantageously shortened by removing unused portions 32'.

If the plug-in mount 1 is then loaded and a switching assembly 2 disposed in the receiving device 5, the contact arms having the first contact regions 701 are pivoted in the direction of the surface of the substrate 3. At the same time, the contact arms with the third contact regions 703 are pivoted away from the surface of the substrate 3.

In the illustration on the right of FIG. 6A, the plug-in mount 1 is loaded with the switching assembly 2 disposed in the receiving device 5. The contact elements 7 bridge the interruption points 37 respectively with the first contact regions 701, so that the corresponding partial regions 341, 342 are connected in an electrically conducting manner. On the other hand, the electrical connections between the first partial contact zone 341 and the terminating zone 34' respectively are discontinued.

In the loaded state, the terminations 36 assigned to the plug-in mount 1 are therefore electrically isolated from the signal lines 32, as represented in the lower part of FIG. 6B. The bridging of the interruption points 37 by the second contact regions 702 has the effect that the signal lines 32 are lengthened, for example to a following plug-in mount or termination.

When the switching assembly 2 is removed from the receiving device 5, the contact element 7 pivots back again into the original position.

The terminations 36 assigned to the plug-in mount 1 are disposed symmetrically on the rear side, so that a common $V_{TT}$ line ($V_{TT}$ island) 38 can be provided in an easy way.

We claim:

1. A configuration for fixing and contacting a switching assembly having contact areas to a contact zone on a substrate having a surface, the configuration comprising:

a plug-in mount disposed on the substrate and having at least one receiving device and a contact element with a contact region and a further contact region for receiving the switching assembly; and signal lines disposed on the substrate, said signal lines having contact zones disposed on the surface of the substrate facing said plug-in mount, and in an unloaded state of the configuration, without the switching assembly disposed in said receiving device, said contact element being electrically isolated from said contact zones, and in a loaded state of the configuration, with the switching assembly disposed in said receiving device, said contact region of said contact element electrically contacting at least one of said contact zones on the substrate;

said further contact region of said contact element electrically contacting at least one of the contact areas of the switching assembly;

said contact region and said further contact region of said contact element being respectively disposed for pivoting about a common axis of rotation and being offset with respect to one another; and in the unloaded state, at least one of said contact region and said further contact region being disposed at least partly in a feed path of the switching assembly and being pivotable by feeding the switching assembly into said receiving device.

2. The configuration according to claim 1, wherein said contact element of said plug-in mount is one of a plurality of contact elements.

3. The configuration according to claim 2, wherein said plug-in mount has an insulating body with a groove formed therein, said receiving device being said groove defined by inner surfaces of said insulating body and said contact elements are disposed on at least one of said inner surfaces of said receiving device and lying opposite the contact areas disposed on at least one edge of the switching assembly.

4. The configuration according to claim 3, wherein said contact elements are disposed on two of said inner surfaces of said receiving device lying opposite one another.

5. The configuration according to claim 2, wherein said contact elements are formed as contact spring elements which are relaxed in the unloaded state and tensioned in the loaded state.

6. The configuration according to claim 2, wherein said contact elements are displaceable at least in a direction perpendicular to the substrate and are disposed at a point remote from the substrate in the unloaded state and at a point near the substrate in the loaded state.

7. The configuration according to claim 3, wherein said contact elements are each elastically deformable in a direction perpendicular to the substrate and parallel to the substrate and in the unloaded state of said plug-in mount, have a minimal extent in the direction perpendicular to the substrate and a maximum extent in the direction parallel to the substrate and in the loaded state have a maximum extent in the direction perpendicular to the substrate and a minimal extent in the direction parallel to said substrate.

8. The configuration according to claim 7, wherein said contact elements are each formed substantially elliptically, are fixed at an anchoring point to said inner sides of said receiving device and are disposed substantially perpendicular to the surface of the substrate and of the switching assembly in the loaded state.

9. The configuration according to claim 1, further comprising a control module; and wherein at least one of said signal lines on the substrate has an interruption point formed therein and two partial contact zones each disposed on one side of said interruption point, said partial contact zones include a first partial contact zone being oriented toward said control module and a second partial contact zone, and in the loaded state, said two partial contact zones of said signal line are respectively electrically connected to one another by said contact region of said contact element corresponding to said signal line.

10. The configuration according to claim 9, wherein said contact element has an additional contact region;

further comprising a termination; and further comprising at least one terminating zone disposed on the surface of the substrate and connected in an electrically conducting manner to said termination, in the unloaded state said terminating zone is connected in an electrically conducting manner to said first partial contact zone by said additional contact region and in the loaded state said terminating zone is electrically isolated from said first partial contact zone.

11. The configuration according to claim 10, wherein one of said contact zones and said partial contact zones and said terminating zone have a greater transverse extent than said signal lines.

12. The configuration according to claim 10, wherein one of said contact zones and said partial contact zones and said terminating zone are one of formed from a gold alloy and coated with said gold alloy.

13. The configuration according to claim 1, wherein one of said contact region and said further contact region of said contact element functions as a mechanical lever disposed at least partly in the feed path of the switching assembly and can be pivoted by feeding the switching assembly into said receiving device.

* * * * *